US005351471A

United States Patent [19]

Gabalda et al.

[11] Patent Number: 5,351,471

[45] Date of Patent: Oct. 4, 1994

[54] MACHINE HAVING A REDUCED HEIGHT FOR TWISTING AND TEXTURING A YARN

[75] Inventors: Carlos M. Gabalda, Granges les Valence; Gilles Ambrois, Saint Marcel les Valence, both of France

[73] Assignee: ICBT, France

[21] Appl. No.: 941,168

[22] Filed: Sep. 4, 1992

[30] Foreign Application Priority Data

Sep. 20, 1991 [FR] France ..... 91 11882

[51] Int. Cl.[5] ..... D01H 13/26; D02G 3/02

[52] U.S. Cl. ..... 57/284; 57/58.57; 57/290

[58] Field of Search ..... 57/58.52, 58.57, 284, 57/290; 28/249

[56] References Cited

U.S. PATENT DOCUMENTS

| | | | |
|---|---|---|---|
| Re. 30,159 | 11/1979 | Kubler | 57/291 |
| 2,180,047 | 2/1957 | Vandamme et al. | 57/284 |
| 3,292,354 | 12/1966 | Chalfont et al. | 57/34 |
| 3,362,148 | 1/1968 | Hofstetter | 57/284 |
| 4,015,414 | 4/1977 | Sholly | 57/284 X |
| 4,025,697 | 5/1977 | Bucher et al. | 57/290 |
| 4,592,195 | 6/1986 | Chardonnier | 57/58.36 |

FOREIGN PATENT DOCUMENTS

| | | | |
|---|---|---|---|
| 0155240 | 9/1985 | European Pat. Off. . | |
| 2055568 | 5/1972 | Fed. Rep. of Germany | 57/284 |
| 1190668 | 10/1959 | France . | |
| 2271313 | 10/1973 | France | 57/284 |
| 2565261 | 12/1985 | France . | |

*Primary Examiner*—Daniel P. Stodola
*Assistant Examiner*—William Stryjewski
*Attorney, Agent, or Firm*—Parkhurst, Wendel & Rossi

[57] ABSTRACT

Machine for carrying out twisting and an additional texturing treatment continuously on a man-made yarn, wherein false-twist texturing treatment elements (6) are arranged in the central part (2) of the stand of the machine, and the feeding elements (7, 10) for feeding the yarn consist of delivery devices of the positive type. A double-twist spindle (3) and the winding assembly (5) are arranged one above the other and are laterally offset. The guidance of the yarn (5) at the exit of the double-twist spindle (3), in order to convey it into the texturing treatment zone (6), and at the exit of said texturing zone, in order to convey it to the winding members (11), is obtained by an assembly (13) comprising, for each work station, a pair of yarn guides (15, 16) supported at the same level on the stand of the machine substantially at mid-height. One guide (15) is arranged in the extension of the double-twist spindle (3), and the other guide (16) is offset laterally outwardly from the one guide (15).

8 Claims, 2 Drawing Sheets

MACHINE HAVING A REDUCED HEIGHT FOR TWISTING AND TEXTURING A YARN

BACKGROUND OF THE INVENTION

1. Field of the Invention

The present invention relates to an improved machine making it possible to carry out treatment of yarn continuously, and particularly a machine making it possible to twist, then to texturize, particularly by false twisting, and finally to wind the yarn thus treated onto a suitable support.

2. Related Art

It is concerned more particularly with an improved installation making it possible to conduct the process described in French Patent No. 1,190,668.

In general terms, textile machines making it possible to conduct the process which is the subject of the abovementioned patent consist of a plurality of identical work stations arranged on either side of a central supporting stand. Each work station comprises from the bottom upwards:

a single-twist or double-twist spindle supporting a package of yarn;

means for feeding the yarn;

a thermal treatment oven which is arranged in the extension of the axis of the double-twist spindle and downstream of which is arranged a false-twist spindle;

means for feeding the yarn at the exit of the double-twist spindle;

and finally, means for winding said treated yarn.

Such an installation is technically satisfactory, its only disadvantage being that, as is well known, when treatment speeds are to be increased, the length of the thermal treatment oven and the cooling space between the oven and the false-twist spindle must be increased. Consequently, the installation has a very large overall height in view of the essentially aligned arrangement of the various treatment members.

Moreover, it is well known, as emerges from French Patent No. 2,565,261 (corresponding to U.S. Pat. No. 4,592,195), that, when the winding of a yarn is carried out by means of a constant-speed reeling device having a movable yarn guide distributing the coils over the length of the reel, it is preferable to have a very large distance between, on the one hand, the last guide point for the yarn, located substantially in the transverse plane passing through the middle of the stroke of the movable yarn guide and, on the other hand, on the guide point itself.

Consequently, all the proposals made hitherto to solve the above-mentioned problems of an increase in speed, whilst having a highly compact machine, result, as emerges particularly from European Patent 155,240, in assemblies which have highly complex yarn paths and which, above all, do not make it possible to preserve the alignment of the various members of the false-twist zone, this alignment being one of the operating conditions for obtaining a yarn of good quality.

Now there has been found, this being the subject of the present invention, an improved machine which makes it possible to preserve the advantages of machines having a structure similar to that which is the subject of French Patent 1,190,668. Moreover, the present invention not only makes it possible to increase the treatment speeds and to have a large distance between the last guide point of the yarn at the exit of the treatment assembly and the winding system, but also, without special conversion or adaptation, allows the use of a thermal treatment member (oven) necessary for the false-twist operation in order to carry out an additional thermal treatment, for example a preliminary treatment for setting the yarn twisted by the double-twist spindle, this taking place before the actual false-twist treatment is carried out.

In general terms, the machine according to the invention is of the type comprising a central stand supporting a plurality of work stations arranged on either side of the central axis of said stand, each station comprising:

a double-twist spindle supporting a package of yarn intended to be treated;

means which make it possible to subject the twisted yarn leaving the double-twist spindle to a texturing treatment, particularly by false twist, and which comprise, arranged in such a way that the path of the yarn is kept substantially rectilinear, in this false-twist zone, means for feeding the twisted yarn, a thermal treatment member followed by a cooling zone and by the actual false-twist spindle, and a system for feeding the yarn at the exit of the texturing treatment zone;

means for winding the treated yarn.

The machine according to the invention is characterised in that:

the false-twist texturing treatment means is arranged in the central part of the stand of the machine, and the means for feeding the yarn which this treatment zone comprises consists of delivery devices of the positive type;

the double-twist spindle and the winding assembly are arranged one above the other and are offset relative to this central zone; and A the guidance of the yarn at the exit of the double-twist spindle, in order to convey it into the texturing treatment zone, and at the exit of said texturing zone, in order to convey it to the winding members, is obtained by means of an assembly comprising, for each work station, a pair of yarn guides supported at the same level on the stand of the machine substantially at midheight of the latter, one arranged in the axis of passage of the double-twist spindle and the other being offset outwards and arranged substantially level with the outer surface of the volume generated by the balloon of yarn of the double-twist spindle.

Advantageously and in practice, according to a preferred embodiment of a machine according to the invention, the guide elements for the yarn are mounted on a support which is vertically adjustable in relation to the stand of the machine. Moreover, such guide means can be designed to serve as break detectors. Furthermore, an additional return element for the yarn is advantageously provided in the region of the upper part of the thermal treatment member (oven) of the false-twist zone, thus making it possible to subject the twisted yarn leaving the double-twist spindle to a preliminary thermal treatment, before it undergoes the actual false-twist treatment.

BRIEF DESCRIPTION OF THE DRAWINGS

The invention and the advantages which it affords will be more clearly understood from the exemplary embodiment which is given below and which is illustrated by the accompanying diagrams in which.

DETAILED DESCRIPTION OF THE PREFERRED EMBODIMENTS

Figure 1:
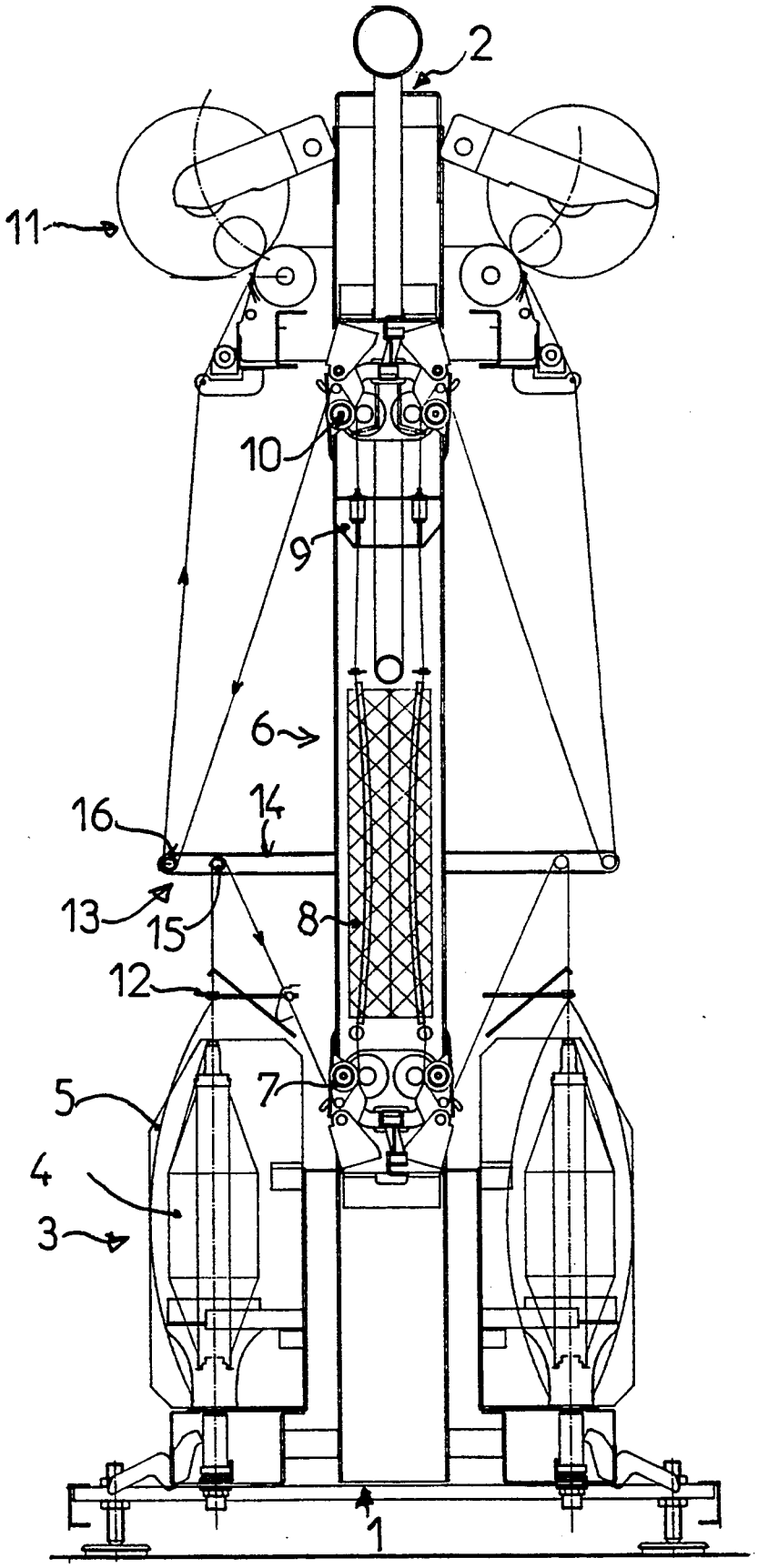
FIG. 1 is a side view of a machine according to the invention, showing the structure of two work stations of such a machine which are arranged on each face of the machine, the path of the yarn on each of the stations being illustrated, with a conventional twist treatment followed by a false-twist operation being carried out.

As can be seen in the drawings, and more particularly in FIG. 1, the machine according to the invention comprises identical work stations arranged on either side of a supporting stand comprising essentially a base (1) and a vertical central stand (2). Each work station comprises a double-twist spindle which is designated by the general reference (3) and which supports a reel (4) of the yarn (5) to be treated. The double-twist spindle (3) makes it possible to impart to the yarn (5) two twisting turns for each rotation of the spindle. In a known way, a stationary yarn-guide lappet (12) is arranged above the double-twist spindle (3) in the extension of its axis.

Downstream of the double-twist assembly (3) is arranged a false-twist texturing zone which is designated by the general reference (6) and which comprises, in the direction of the path of the yarn, a delivery device (7), a thermal treatment oven (8), a false-twist spindle (9) and an exit delivery device (10). Guide eyes (18, 20) are arranged at the entrance and at the exit of the oven (8).

Downstream of the exit delivery device (10) is arranged the winding assembly (11) for the treated yarn.

The delivery devices (7) and (10) arranged at the entrance and at the exit of the false-twist texturing zone (6) are conventional delivery devices of the positive type, allowing pulley-block operation and therefore very high accuracy in the feed speed of the yarn and under the treatment conditions within the false-twist zone.

According to the invention, and as emerges from the accompanying FIG. 1, the treatment members as a whole are arranged in such a way that the false-twist texturing zone (6) is located in the central part of the machine, whilst the double-twist spindle (3) and the winding means (11) are themselves offset laterally relative to this central zone.

In such a machine, the guidance of the yarn (5) between the exit of the double-twist spindle (3) and the texturing zone (6) is obtained by means of a return assembly designated by the general reference (13). Such a return assembly (13) is composed essentially of a support (14) mounted preferably vertically adjustably on the central part of the stand of the machine. At the end of the support (14) are arranged two yarn guide and return elements (15, 16) preferably consisting of ceramic rollers. One of the guides (15) is arranged in the axis of passage of the yarn at the exit of the double-twist spindle (3), whilst the second (16) is itself arranged at the side level, but offset outwards substantially in line with the volume generated by the balloon of yarn (5) in the double-twist spindle.

Figure 2:
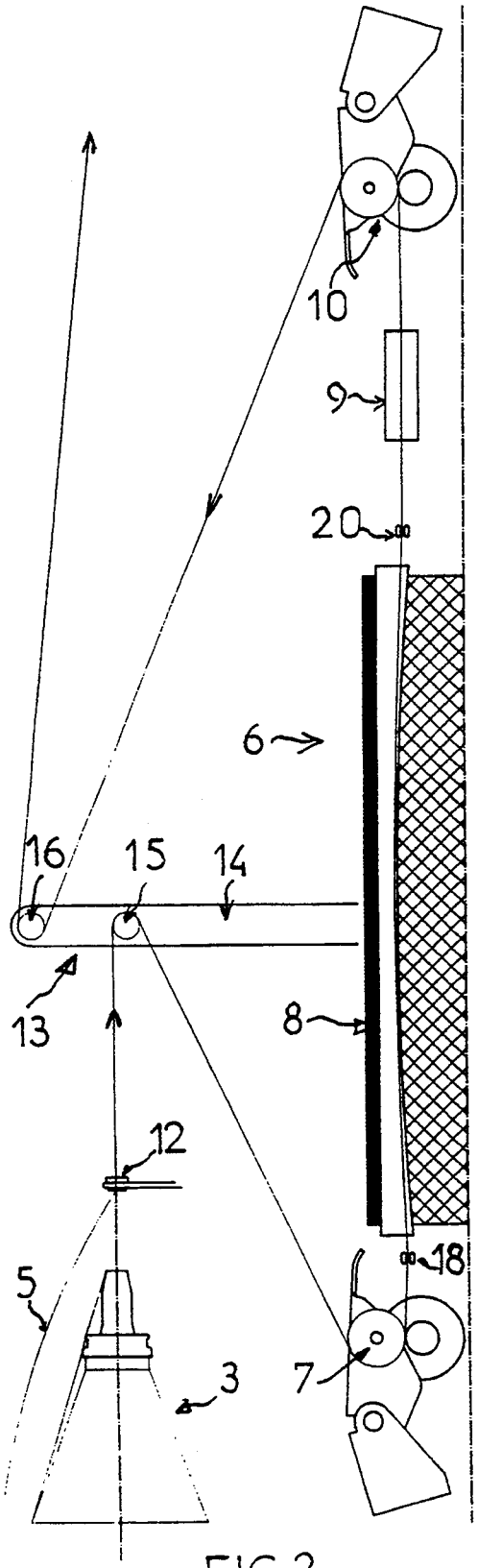
FIG. 2 is an enlarged detailed view showing how, according to the invention, the yarn is deflected at the exit of the double-twist spindle and after the false twist during a conventional treatment operation.
Figure 3:
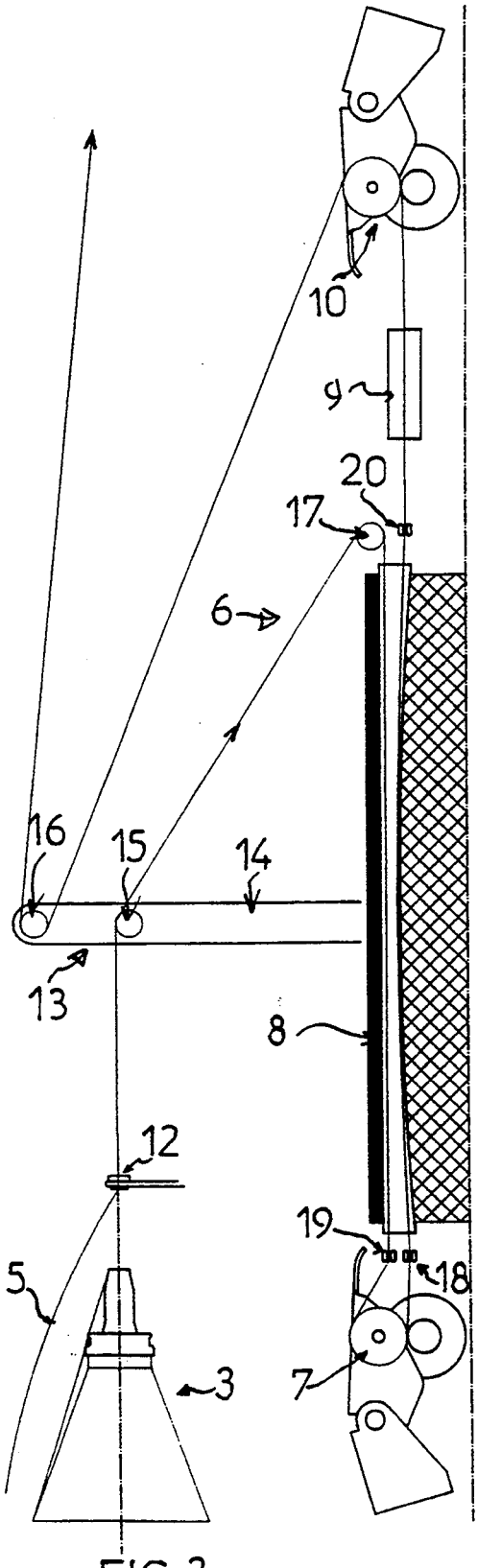
FIG. 3 illustrates, likewise in an enlarged view, an alternative embodiment which a machine according to the invention allows and in which the twisted yarn coming from the double-twist spindle undergoes a thermal treatment, before re-entering the actual false-twist zone.

In relation to the structures of machines proposed hitherto which make it possible to carry out continuously a twist treatment followed by a false-twist texturing treatment, such a design not only makes it possible to reconcile the contradictory requirements, namely the possibility of a high production speed, whilst at the same time having a compact assembly, an aligned path of the yarn in the false-twist texturing zone and a large distance between the exit of the texturing band and the winding system. In addition, as emerges from the detailed views illustrated in FIGS. 2 and 3, it makes it possible not only to carry out a conventional twist treatment followed by a false twist, as shown in FIG. 2, but also to use the same machine for carrying out special treatments, for example, as emerges from FIG. 3, for carrying out a preliminary thermal treatment of the twisted yarn leaving the double-twist spindle (3), this taking place before it undergoes the actual false-twist texturing operation. In fact, to carry out such a treatment, it is sufficient to provide in the region of the upper part of the oven (6) an additional return element (17) for the yarn (5) and an additional guide eye (19) between the oven (8) and the entry delivery device (7).

Finally, it is possible to use such a type of machine, without costly adaptation or conversion, in order either to carry out a conventional false-twist treatment, in which case it is sufficient to replace the double-twist spindles (3) by a stationary yarn-supply source not imparting any twist, or, if appropriate, to conduct a simple twist-setting operation by putting the false-twist spindles (9) out of action. It is expedient to note that such a type of installation makes it possible, moreover, to arrange members for detecting and monitoring the yarn during its treatment in a single zone in the region of the return assembly (13), thereby making it possible easily to monitor the presence or absence of yarn both upstream and downstream of the false-twist zone. Such yarn detection and monitoring men, bets can consist of the return elements themselves.

Such a design of the machine has many advantages in relation to the prior solutions, especially as regards its flexibility of use which allows the production of a very wide variety of different yarns, this being brought about simply by acting on the adjustment of the tension which is imparted to the yarns in the various treatment zones and as demonstrated by the practical examples given below as a non-limiting indication.

EXAMPLE 1

Production of a yarn of the "textured crêpe" type from a polyester yarn having a count of 78 dtex and comprising 70 filaments Such a yarn is produced on the machine according to the invention by employing the following settings:

| | | |
|---|---|---|
| speed of the double-twist spindle (3): | 10,800 | rev/min |
| twist imparted by the spindle (3): | 1,234 | T/Z per meter |
| Speed of the first feed system (7): | 17.50 | m/min |
| Speed of the texturing spindle (9): | 49,000 | rev/min |
| Texturing twist: | 2,800 | T/Z |
| Speed of the second feed (10): | 17.08 | m/min |
| Tension at the exit of the spindle (3): | 55/56 | grams |
| Tension at the entrance of the false-twist spindle (9): | 11/13 | grams |
| Tension at the exit of the false-twist spindle: | 25/26 | grammes |
| Receiving speed of the winding means (11): | 16.62 | m/min |

-continued

| | |
|---|---|
| Receiving tension at the winding means (11): | 5/6 grammes |
| Temperature of the oven (8): | 210° C. |

EXAMPLE 2

Production of a yarn of the "textured crêpe" type from a polyester yarn having a count of 100 dtex and comprising 36 filaments The machine according to the invention is set as follows:

| | |
|---|---|
| Speed of the double-twist spindle (3): | 10,800 rev/min |
| twist imparted by the spindle (3): | 1,128 T/Z per meter |
| Speed of the first feed system (7): | 19.14 m/min |
| Speed of the texturing spindle (9): | 45,150 rev/min |
| Texturing twist: | 2,358 T/Z |
| Speed of the second feed (10): | 18.68 m/min |
| Tension at the exit of the spindle (3): | 73/75 grams |
| Tension at the entrance of the false-twist spindle (9): | 15/16 grams |
| Tension at the exit of the false-twist spindle: | 30 grams |
| Receiving speed of the winding means (11): | 17.89 m/min |
| Receiving tension at the winding means (11): | 5 grams |
| Temperature of the oven (8): | 205° C. |

EXAMPLE 3

Production of a fancy yarn having flame effects

To produce such a type of yarn, a plyester yarn of 167 dtx/48 filaments is used, the machine according to the invention being set as follows:

| | |
|---|---|
| Speed of the double-twist spindle (3): | 9,600 rev/min |
| twist imparted by the spindle (3): | 630 T/Z per meter |
| Speed of the first feed system (7): | 30.5 m/min |
| Speed of the texturing spindle (9): | 53,321 rev/min |
| Texturing twist: | 1,748 T/Z |
| Speed of the second feed (10): | 25.77 m/min |
| Tension at the exit of the spindle (3): | 85 grams |
| Tension at the entrance of the false-twist spindle (9): | 5.5 grams |
| Tension at the exit of the false-twist spindle: | 11.12 grams |
| Receiving speed of the winding means (11): | 25.56 m/min |
| Receiving tension at the winding means (11): | 7 grams |
| Temperature of the oven (8): | 240° C. |

The foregoing examples show the high flexibility of use of the machine according to the invention which makes it possible to obtain different yarns simply by modifying the settings (tension, spindle speed).

We claim:

1. A machine for twisting and texturing by false twisting a man-made yarn, said machine comprising at least two working stations arranged on opposite sides of a central stand, each working station comprising:

a double-twist spindle supporting a package of yarn texturing means for texturing the yarn after being twisted by the double-twist spindle, said texturing means comprising a thermal treatment oven, positively driven first and second feeding devices for accurately feeding the yarn to the thermal treatment oven, and a cooling zone and a false-twist spindle for cooling and false-twisting the yarn, the thermal treatment oven, the cooling zone and the false-twist spindle being disposed between the first and second feeding means, the first and second feeding means being aligned along a first direction corresponding to a height of the machine so as to maintain the yarn passing therebetween substantially rectilinear;

winding means for winding the yarn after texturing, wherein said winding means and double-twist spindle are laterally offset from said texturing means along a second direction which is perpendicular to said first direction; and guide means for (i) guiding the yarn from the double-twist spindle to the first feeding means and (ii) guiding the yarn from the second feeding means to the winding means, wherein the guide means comprises first and second yarn guides arranged side-by-side, said second yarn guide being positioned laterally outwardly from the first yarn guide along said second direction.

2. The machine of claim 1 wherein the first yarn guide is positioned along an extended line from the longitudinal axis of said double-twist spindle, said extended line being parallel to said first direction.

3. The machine of claim 1, wherein the yarn guides are positioned at about mid-height of the machine.

4. The machine of claim 1, wherein sad first and second yarn guides are mounted on a support.

5. The machine of claim 4, wherein said support is adjustable along the first direction.

6. The machine of claim 1, further comprising a return element positioned to direct the yarn preliminary through the thermal treatment oven before being fed through the thermal treatment oven via the first and second feeding means.

7. The machine of claim 1, wherein the first and second yarn guides are adapted to detect breaks int he yarn.

8. A machine for twisting and texturing by false twisting a man-made yarn, said machine comprising at least two working stations arranged on opposite sides of a central stand, each working station comprising:

a double-twist spindle supporting a package of yarn;

texturing means for texturing the yarn after being twisted by the double-twist spindle, said texturing means comprising a thermal treatment oven, positively driven first and second feeding devices for accurately feeding the yarn to the thermal treatment oven, and a cooling zone and a false-twist spindle for cooling and false-twisting the yarn, the thermal treatment oven, the cooling zone and the false-twist spindle being disposed between the first and second feeding means, the first and second feeding means being aligned along a first direction corresponding to a height of the machine so as to maintain the yarn passing therebetween substantially rectilinear;

winding means for winding the yarn after texturing, wherein said winding means and double-twist spindle are laterally offset from said texturing means along a second direction which is perpendicular to said first direction; and guide means for (i) guiding the yarn from the double-twist spindle to the first feeding means and (ii) guiding the yarn from the second feeding means to the winding means, said guid means comprising first and second yarn guides arranged side-by-side at about mid-height of the machine, said second yarn guide being positioned laterally outwardly from the first yarn guide along said second direction, the first yarn guide being positioned along an extended line from the longitudinal axis of said double-twist spindle, said extended line being parallel to said first direction.

* * * * *